US009015979B2

(12) United States Patent
Safewright, Jr.

(10) Patent No.: US 9,015,979 B2
(45) Date of Patent: Apr. 28, 2015

(54) SELECTABLE DOUBLE TUBE MAGAZINE

(71) Applicant: Randall L. Safewright, Jr., Knoxville, TN (US)

(72) Inventor: Randall L. Safewright, Jr., Knoxville, TN (US)

( * ) Notice: Subject to any disclaimer, the term of this patent is extended or adjusted under 35 U.S.C. 154(b) by 0 days.

(21) Appl. No.: 13/852,538

(22) Filed: Mar. 28, 2013

(65) Prior Publication Data

US 2014/0000143 A1 Jan. 2, 2014

Related U.S. Application Data

(60) Provisional application No. 61/616,726, filed on Mar. 28, 2012.

(51) Int. Cl.
*F41A 9/72* (2006.01)
*F41A 9/71* (2006.01)

(52) U.S. Cl.
CPC .... *F41A 9/71* (2013.01); *F41A 9/72* (2013.01)

(58) Field of Classification Search
CPC ..... F41A 9/18; F41A 9/19; F41A 9/72
USPC ..... 42/49.01, 49.02; 89/33.04
See application file for complete search history.

(56) References Cited

U.S. PATENT DOCUMENTS 618,369 A * 1/1899 Wilson ..... 42/49.01
810,310 A * 1/1906 Sparks ..... 42/49.01
4,416,076 A * 11/1983 Ottolini ..... 42/17
4,679,486 A 7/1987 Landaas
4,867,039 A 9/1989 Dobbins
4,882,973 A 11/1989 Piscetta
4,905,395 A * 3/1990 Wagner ..... 42/17
5,367,810 A * 11/1994 Stead et al. ..... 42/17
6,135,005 A 10/2000 Dobbins
6,250,194 B1 6/2001 Brandl et al.
2004/0020093 A1* 2/2004 Hajjar et al. ..... 42/49.01
2007/0240352 A1* 10/2007 Pullicar ..... 42/70.11
2013/0081314 A1* 4/2013 Hatfield ..... 42/1.02

OTHER PUBLICATIONS

Kel-Tec KSG, from Wikipedia, http://en.wikipedia.org/wiki/Kel-Tec_SKG, Printed: Dec. 6, 2013.
UTAS UTS-15, from Wikipedia, http://en.wikipedia.org/wiki/UTAS_UTS-15, Printed: Dec. 6, 2013.

* cited by examiner

*Primary Examiner* — Bret Hayes
(74) *Attorney, Agent, or Firm* — Robinson IP Law, PLLC

(57) ABSTRACT

A selectable double-chamber magazine firearm is disclosed. The double-chamber magazine firearm includes a receiver, at least one barrel adjacent the receiver, and a double-chamber magazine releasably secured to the receiver. The double-chamber magazine includes a first elongate magazine chamber and a second elongate magazine chamber adjacent to and parallel with the first elongate magazine chamber. The firearm further includes a selector secured adjacent an open end of the first elongate magazine chamber and an open end of the second elongate magazine chamber. The selector is configured to move between a first position such that the selector at least partially obstructs the open end of the second elongate magazine chamber and a second position such that the selector at least partially obstructs the open end of the first elongate magazine chamber.

15 Claims, 6 Drawing Sheets

SELECTABLE DOUBLE TUBE MAGAZINE

CROSS-REFERENCE TO RELATED APPLICATION

This application claims priority to U.S. Provisional Application No. 61/616,726 filed Mar. 28, 2012, the entirety of which is incorporated herein by reference.

FIELD

This disclosure relates to the field of firearms. More particularly, this disclosure relates to a detachable double-magazine for a shotgun.

BACKGROUND

Firearms typically allow a user to load the firearm with a desired ammunition. When a user desires to change the type of ammunition, the user must either discharge all rounds of the previous ammunition or remove them from the firearm.

Further, if a user loads a firearm with two types of ammunition, the user may be unable to select the desired ammunition. For example, if alternating types of ammunition are loaded into the firearm, the user has no control over the ammunition to be discharged by the firearm.

What is needed, therefore, is a firearm having a selectable double-chamber magazine.

SUMMARY

The above and other needs are met by a selectable double-chamber magazine firearm is disclosed. The double-chamber magazine firearm includes a receiver, at least one barrel adjacent the receiver, and a double-chamber magazine releasably secured to the receiver. The double-chamber magazine includes a first elongate magazine chamber and a second elongate magazine chamber adjacent to and parallel with the first elongate magazine chamber. The firearm further includes a selector secured adjacent an open end of the first elongate magazine chamber and an open end of the second elongate magazine chamber. The selector is configured to move between a first position such that the selector at least partially obstructs the open end of the second elongate magazine chamber and a second position such that the selector at least partially obstructs the open end of the first elongate magazine chamber.

In a one embodiment the selectable double-chamber magazine firearm further includes a first selector striker secured adjacent the open end of the first elongate magazine chamber, a second selector striker secured adjacent the open end of the first elongate magazine chamber, a selector bar secured to the selector between the first selector striker and the second selector striker, a first plunger slidably engaged within the first elongate magazine chamber, and a second plunger slidably engaged within the second elongate magazine chamber. The first plunger includes a first plunger spring between the plunger and a closed end of the first elongate magazine chamber. The second plunger further includes a second plunger spring between the second plunger and a closed end of the second elongate magazine chamber. When the first plunger is adjacent the open end of the first elongate magazine chamber the first plunger contacts the first striker, the first striker moves from a first position to a second position contacting the selector bar and thereby urging the selector from the first selector position to the second selector position. When the second plunger is adjacent the open end of the second elongate magazine chamber the second plunger contacts the second striker, the second striker moves from a first position to a second position contacting the selector bar and thereby urging the selector from the second selector position to the first selector position.

In another embodiment, the selectable double-chamber magazine firearm further comprises a magazine release lever. In yet another embodiment, the magazine release lever is in mechanical communication with the first selector striker and the second selector striker such that when the release lever is activated the first selector striker and second selector striker are turned to the first striker position.

In one embodiment, the selectable double-chamber magazine firearm further includes a first shell retainer pivotally secured to the first elongate magazine chamber and a second shell retainer pivotally secured to the second elongate magazine chamber. The first shell retainer extends at least partially over the open end of the first elongate magazine chamber when the double chamber magazine is released from the receiver, and the second shell retainer extends at least partially over the open end of the second elongate magazine chamber when the double-chamber magazine is released from the receiver.

In another embodiment, the receiver further comprises an elongate barrel secured adjacent the receiver. In yet another embodiment, the double-chamber magazine is positioned above the barrel.

In one embodiment the receiver further comprises a rifle portion.

In another aspect, embodiments of the disclosure provide selectable double-chamber magazine firearm comprising a receiver, a barrel secured adjacent the receiver, and a double-chamber magazine secured to the receiver. The double-chamber magazine includes a first elongate magazine chamber, a second elongate magazine chamber adjacent to and parallel with the first elongate magazine chamber, a first shell retainer pivotally secured to the elongate magazine chamber extending at least partially over the open end of the first elongate magazine chamber when the double-chamber magazine is released from the receiver, and a second shell retainer pivotally secured to the second elongate magazine chamber, the second shell retainer extending at least partially over the open end of the second elongate magazine chamber when the double-chamber magazine is released from the receiver. The selectable double-chamber magazine further includes a selector secured adjacent an open end of the double-chamber magazine. When the selector is in a first configuration, the selector at least partially obstructs the open end of the second elongate magazine chamber, and when the selector is in a second configuration, the selector at least partially obstructs the open end of the first elongate magazine chamber.

In yet another aspect, embodiment of the disclosure provide a method of discharging two different types of ammunition from a firearm. The firearm includes a detachable double-chamber magazine including a first magazine chamber and a second magazine chamber and a receiver. The method includes the steps of (1) inserting one or more rounds of a first type of ammunition into the first magazine chamber, (2) inserting one or more rounds of a second type of ammunition into the second magazine chamber, (3) releasably securing the double chamber-magazine to the receiver of the firearm, (4) selecting one of the first type of ammunition or the second type of ammunition, and (5) discharging the selected first type of ammunition or second type of ammunition.

In one embodiment, after all of the first type of ammunition is discharged the second type of ammunition is automatically selected.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
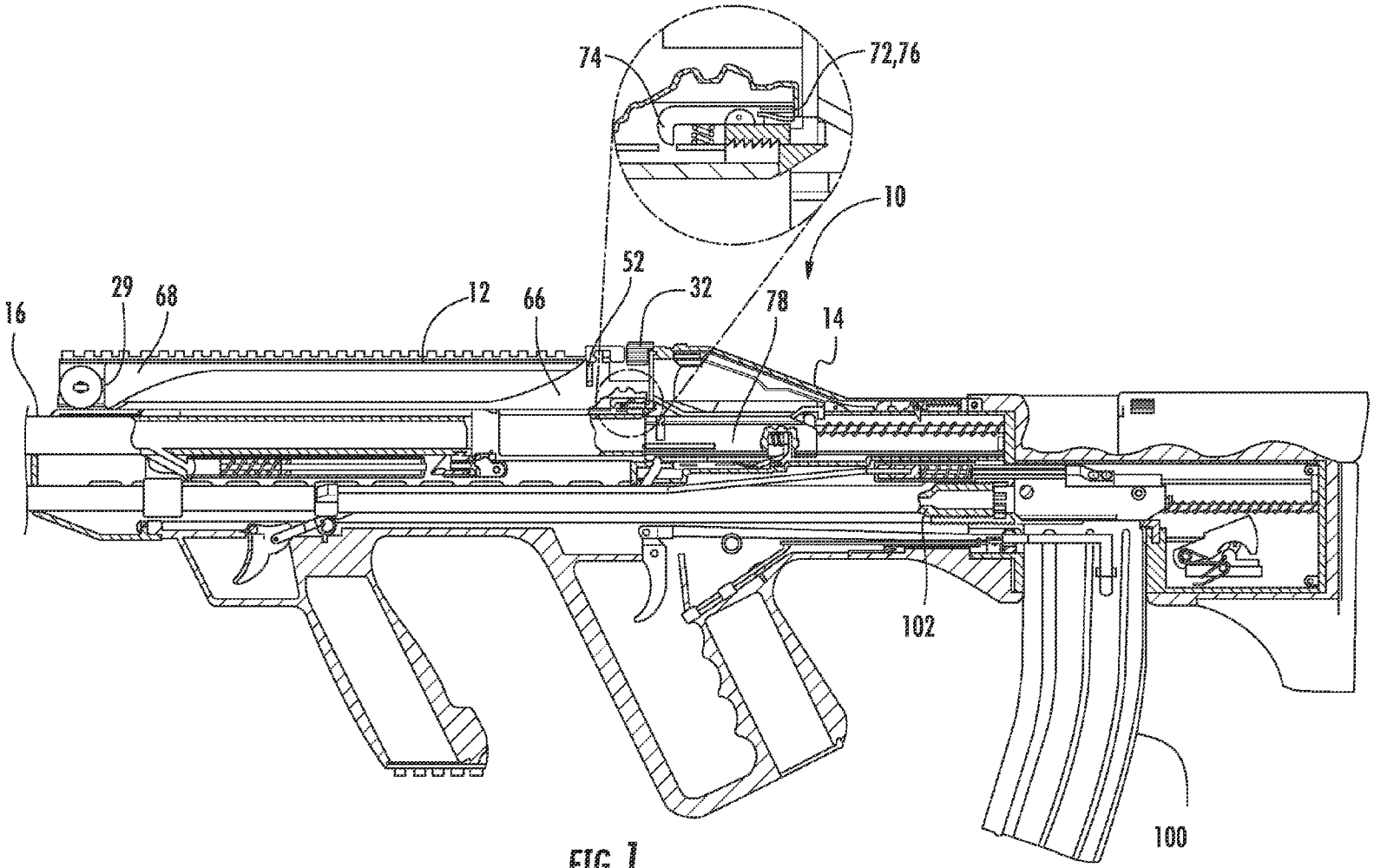
FIG. 1 is a side view of a selectable double-chamber magazine firearm.

FIG. 1 shows a selectable double-chamber magazine firearm 10 having a double-chamber magazine 12, a receiver 14, and a barrel 16. The firearm 10 is preferably a shotgun and most preferably a shotgun/rifle combination as shown in FIG. 1. The double-chamber magazine 12 is preferably releasably secured to the receiver 14. As explained further below, a user is preferably able to select a desired ammunition from the double-chamber magazine 12 for discharge from the firearm 10.

Figure 2:
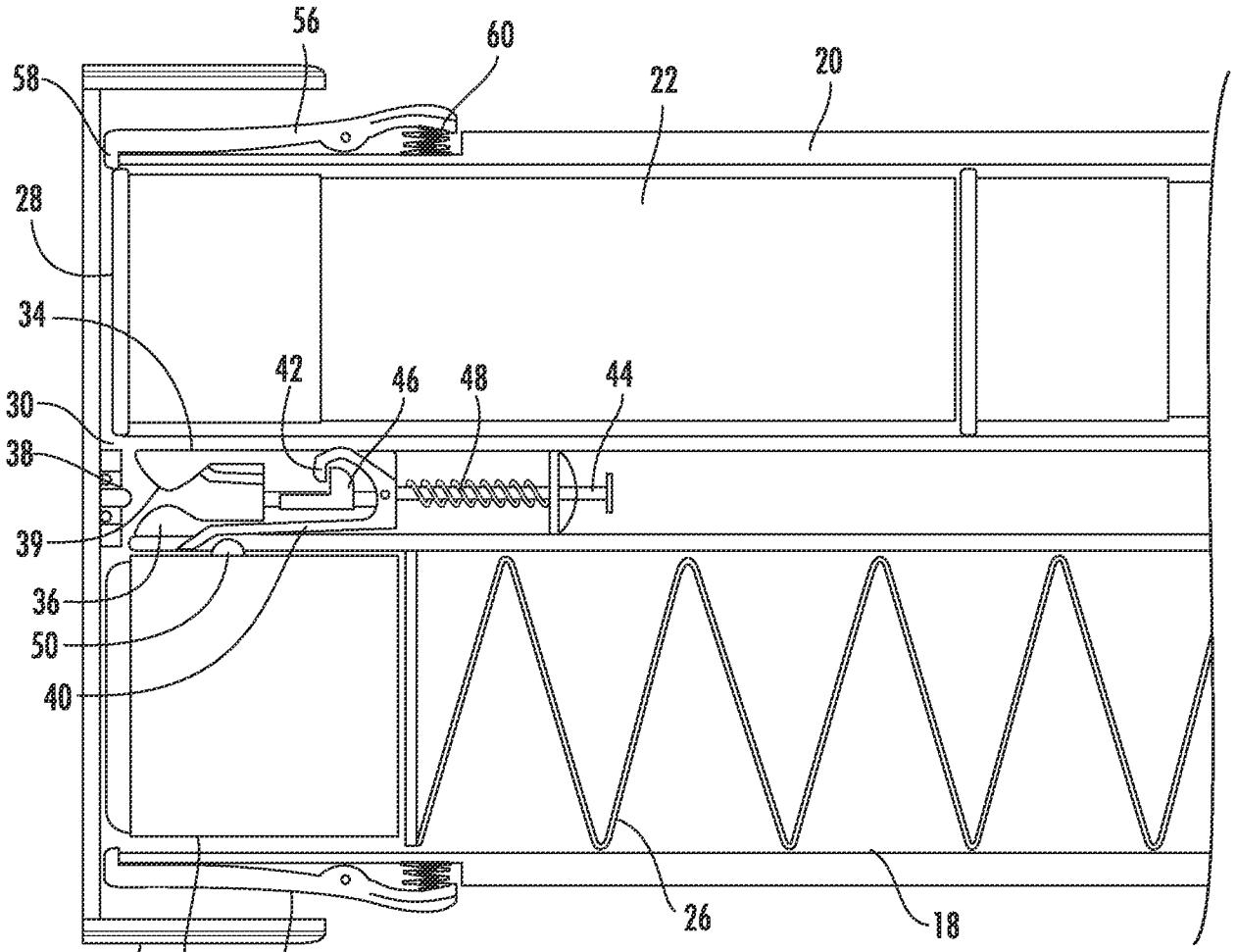
FIG. 2 is a cross-sectional top view of an open end of a selectable double chamber magazine.

Referring to FIG. 2, the double-chamber magazine 12 includes a first elongate magazine chamber 18 and a second elongate magazine chamber 20 adjacent to and parallel with the first magazine chamber 18. The first and second magazine chambers 18 and 20 are sized and configured to receive one or more rounds of ammunition 22. In preferred embodiments, the first and second magazine chambers 18 and 20 are sized and configured to receive various gauge shotgun ammunition such as bird shot, buck shot, slug rounds, home defense ammunition, less lethal or non-lethal ammunition, and other various types of shotgun ammunition known in the art. However, in other embodiments, the first and second magazine chamber 18 and 20 of the double-chamber magazine 12 are sized and configured to hold other types of ammunition such as various rifle and pistol ammunition.

The one or more rounds of ammunition 22 are stored lengthwise within the first and second magazine chambers 18 and 20 as shown in FIG. 2. FIG. 2 is a cross-sectional top view of the double-chamber magazine 12 wherein the second magazine chamber 20 includes one or more rounds of ammunition 22 and where all rounds of ammunition 22 have been forced out of the first magazine chamber 18. The first and second magazine chambers 18 and 20 further include a plunger 24 and plunger spring 26 positioned within the first and second magazine chambers 18 and 20 for urging the one or more rounds of ammunition 22 towards an open end 28 of the first and second magazine chambers 18 and 20. The double-chamber magazine 12 also includes a closed end 29 distal from the open end 28 of the double-chamber magazine 12.

A selector 30 is secured adjacent the open end 28 of the double-chamber magazine 12. The selector 30 is configured to move from a first position to a second position depending on whether a user desires to discharge ammunition from the first magazine chamber 18 or the second magazine chamber 20. The selector 30 is secured to a selector switch 32 disposed at least partially on the exterior of the firearm 10 (FIG. 1) such that the user is able to engage the selector switch 32 to select ammunition from either the first magazine chamber 18 or the second magazine chamber 20 as described below.

Figure 3A:
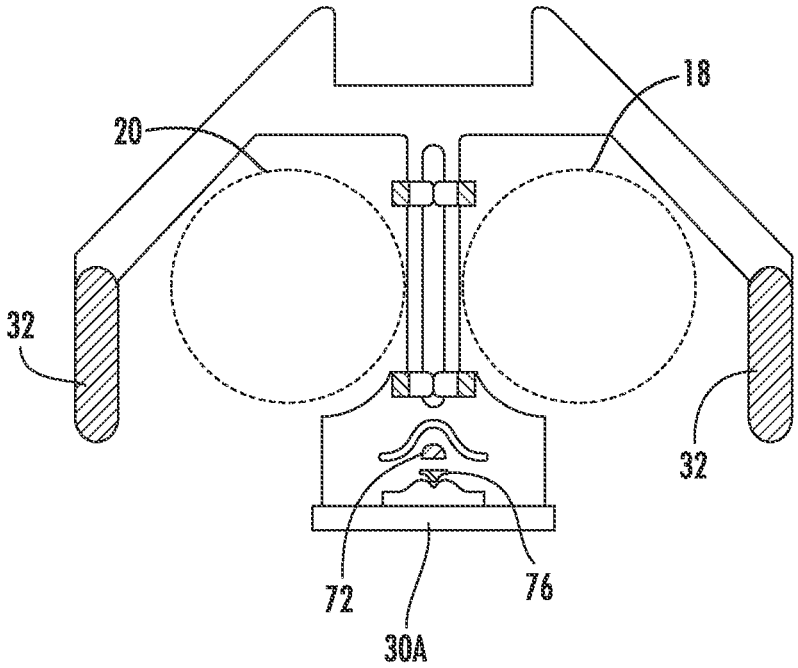
FIGS. 3A-3C and 4 are cross-sectional views of a selectable double-chamber magazine.
Figure 3B:
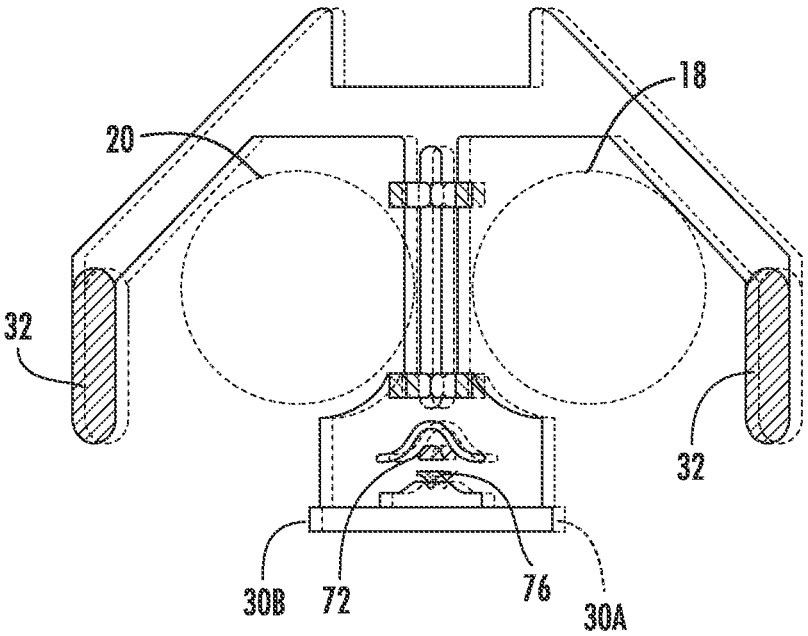
Figure 3C:
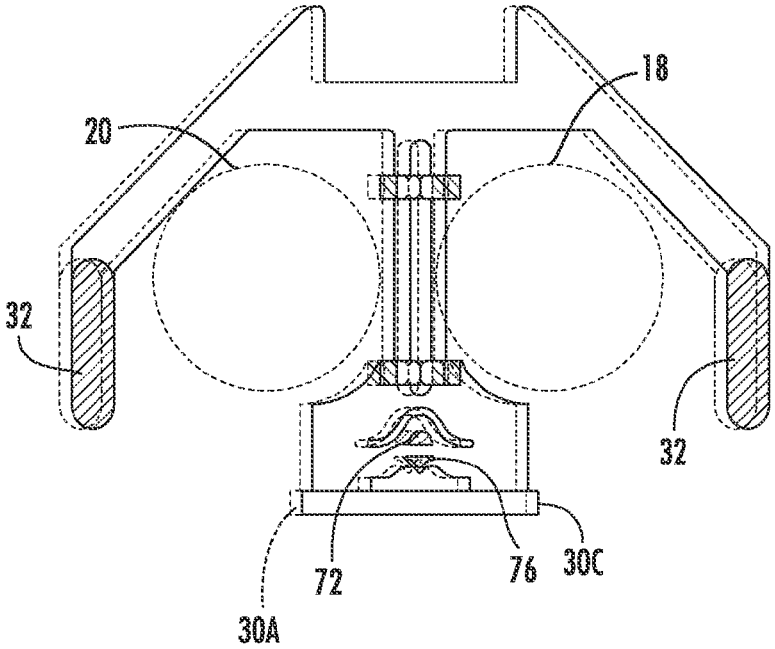

Referring now to FIGS. 3A-3C, the selector 30 is operable to slidably engage the open end 28 of the double-chamber magazine 12 to at least partially block the first magazine chamber 18 or the second magazine chamber 20. In preferred embodiments, the selector includes at least three positions 30A, 30B, and 30C as shown in FIGS. 3A-3C respectively. In a middle position 30A, the selector 30 is disposed an equal distance between the magazine chambers 18 and 20. In some embodiments, the selector may partially block both the first and second magazine chambers 18 and 20 in the middle position 30A which operates as an additional safety position for the firearm 10 or the shotgun portion of the firearm 10 when embodied in the shotgun/rifle combination. Alternately or in addition to the selector 30, carrier latches 62 and 64 prevent ammunition from moving from the magazine 12 to the receiver 14 as explained further below with respect to FIG. 6. In a first position 30B, the selector 30 partially blocks the second magazine chamber 20 thereby preventing any ammunition 22 within the second magazine chamber 20 from being forced through the open end 28 of the double-chamber magazine. When the selector 30 is in the first position 30B, the first magazine chamber 18 is substantially unobstructed such that any ammunition within the first magazine chamber 18 may be forced from the open end 28 of the double chamber magazine by the plunger 24. In a second position 30C, the selector 30 partially blocks the first magazine chamber 18 thereby preventing any ammunition within the first magazine chamber 18 from being forced through the open end 28 of the double-chamber magazine. When the selector 30 is in the second position 30C, the second magazine chamber 20 is substantially unobstructed such that any ammunition within the second magazine chamber 20 may be forced from the open end of the double chamber magazine by the plunger 24.

While the user may designate either the first magazine chamber 18 or the second magazine chamber 20 using the selector switch 32 for manually moving the selector 30 as described above, the double-chamber magazine 12 is preferably also configured to switch automatically between the first magazine chamber 18 and the second magazine chamber 20 when either chamber runs out of ammunition as explained below.

Figure 4:
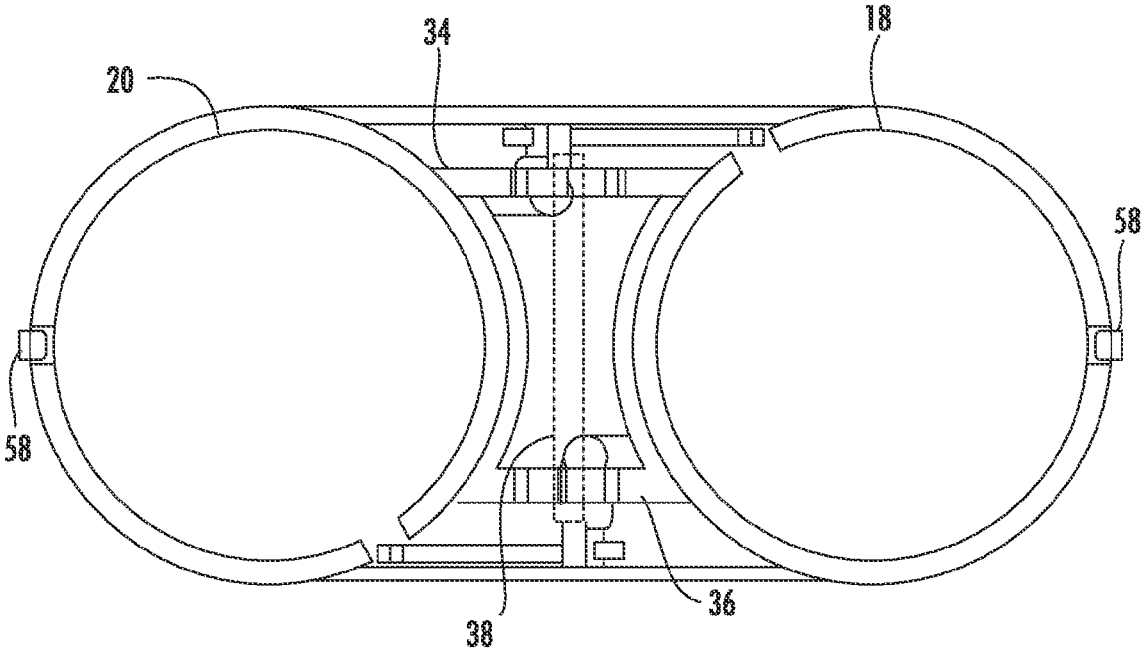

Referring again to FIG. 2, the double-chamber magazine 12 includes a first selector striker 34 and a second selector striker 36. The first and second selector strikers are positioned between the first magazine chamber 18 and second magazine chamber 20. As shown in FIG. 4, the first selector striker 34 is positioned along a top portion of the double-chamber magazine 12 and the second selector striker 36 is positioned along a bottom portion of the double-chamber magazine 12, or vice versa.

The following description of an exemplary selector striker is with reference to the first selector striker 34, the second selector striker 36 being substantially similar to the first striker. FIG. 2 is a top view of the first striker 34 and selector 30. FIG. 2 shows the selector 30 in the first position 30B at a point where a final round of ammunition is forced from the first magazine chamber 18 such that the plunger 24 is adjacent the open end 28 of the double-chamber magazine 12 but before the selector 30 is automatically switched to the second position as explained below.

The selector 30 includes a vertical selector bar 38 secured to the selector 30 and extending along a height of the double-chamber magazine 12 (FIG. 4). The first striker 34 includes a selector striker 39 for contacting the selector bar 38. The first striker 34 also includes a plunger contact arm 40 pivotally secured to the double-chamber magazine 12 adjacent the first magazine chamber 18, a plunger contact arm catch 42 formed on the plunger contact arm 40, and a striker bar 44 including a striker bar catch 46 engaged with the plunger contact arm catch 42. The striker bar 44 includes a striker bar spring 48 urging the striker bar 44 towards the open end 28 of the double-chamber magazine 12. The striker bar 44 and striker 34 are in a "cocked" position when the striker bar catch 46 is engaged with the plunger contact arm catch 42.

With further reference to FIG. 2, the striker 34 contacts the selector bar 38 and selector 30 secured thereto, thereby automatically changing the selector from the first selector position to the second selector position when the first magazine chamber 18 is empty.

When a final round of ammunition is forced out of the first magazine chamber 18 by the plunger 24, the plunger is forced against the open end of the first magazine chamber 18 by the plunger spring 26. A plunger tab 50 secured to the plunger 24 contacts the plunger contact arm 40, causing the plunger contact arm to pivot, disengaging the striker bar catch 46 from the plunger contact arm catch 42.

When the striker bar catch 46 is released from the plunger contact arm catch 42, the striker bar 44, urged by the striker bar spring 48, moves towards the open end 28 of the double-chamber magazine 12. As the striker bar 44 moves towards the open end 28 of the double-chamber magazine 12, the striker bar 44 contacts the striker 34 and forces the selector striker 39 towards the selector bar 38. The selector striker 39 of the striker bar 44 contacts the selector bar 38 and moves the selector 30 from the first position to the second position. When the selector 30 is moved to the second position, any rounds of ammunition within the second magazine chamber 20 are then forced into the receiver 14 of the firearm 10 for discharge.

After the first striker 34 contacts the selector 30, the striker 34 remains in a "de-cocked" position where the first striker 34 remains in a middle position 30A and prevents the selector 30 from returning to the first position until the first striker 34 has been placed back in the cocked position. By preventing the selector 30 from moving back to the first position, a user is prevented from accidentally selecting the empty first magazine chamber 18. Further, when all ammunition is forced out of the second magazine chamber 20, the second striker 36 contacts the selector 30 and returns the selector 30 to a center position and pivots a bolt retainer as described below.

A first striker assembly includes the first striker 34, plunger contact arm 40, plunger contact arm catch 42, striker bar 44, striker bar catch 46, and striker bar spring 48. A second striker assembly is positioned between the first magazine chamber 18 and second magazine chamber 20 such that the second striker 36 contacts the selector bar 38 when a plunger in the second magazine chamber forces all ammunition out of the second magazine chamber 20.

After discharging ammunition from the first magazine chamber 18 and second magazine chamber 20, a user may remove the double-chamber magazine 12 to either reload the magazine or replace the magazine with another magazine containing one or more rounds of ammunition. Referring to FIG. 1, to release the double-chamber magazine 12 from the receiver 14, a user may press a magazine release lever 52. The magazine release lever 52 may be configured to both release the double-chamber magazine 12 from the receiver 14 and also re-cock the first striker 34 and second striker 36.

Figure 5:
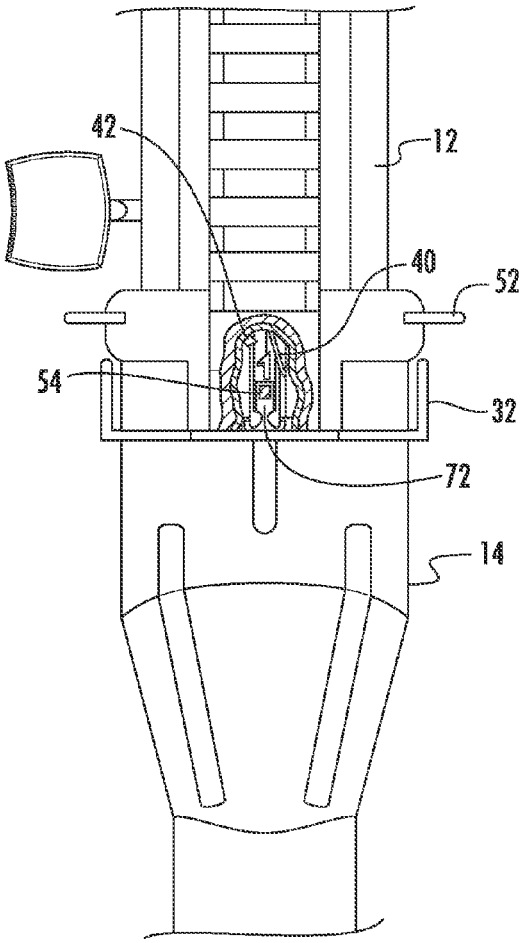
FIGS. 5 and 6 are a cross-sectional top view of a selectable double-chamber magazine firearm.

Referring now to FIG. 5, a top view of the magazine release lever 52 is shown. The magazine release lever 52 may include a striker cocking rod 54. The striker cocking rod 54 may extend into the receiver 14 such that when the magazine release lever 52 is activated to release the double-chamber magazine 12, the striker cocking rod 54 extends to contact the striker bar 44 (FIG. 2). When the striker cocking rod 54 contacts the striker bar 44, the striker bar 44 is moved back to its initial position where the plunger contact arm catch 42 and striker bar catch 46 are re-engaged.

The double chamber magazine 12 may include a pair of shell retainers 56 for retaining the one or more rounds of ammunition 22 within the double-chamber magazine 12 when the magazine is not secured to the receiver 14. The shell retainers 56 may be pivotally secured to the first magazine chamber 18 and second magazine chamber 20 and include a tab 58 extending over a portion of the open end 28 of the double-chamber magazine 12. The shell retainers may also include a retainer spring 60 exerting an outward force on the retainers 56 forcing the tab 58 inward over the open end 28 of the double-chamber magazine 12. When the double chamber magazine 12 is attached to the receiver 14, the receiver 14 contacts the shell retainers 56 adjacent the retainer spring 60 causing the retainers 56 to pivot such that the tab 58 is removed from the open end 28 of the double-chamber magazine 12, allowing one or more rounds of ammunition 22 to be forced from the magazine into the receiver 14.

Figure 6:
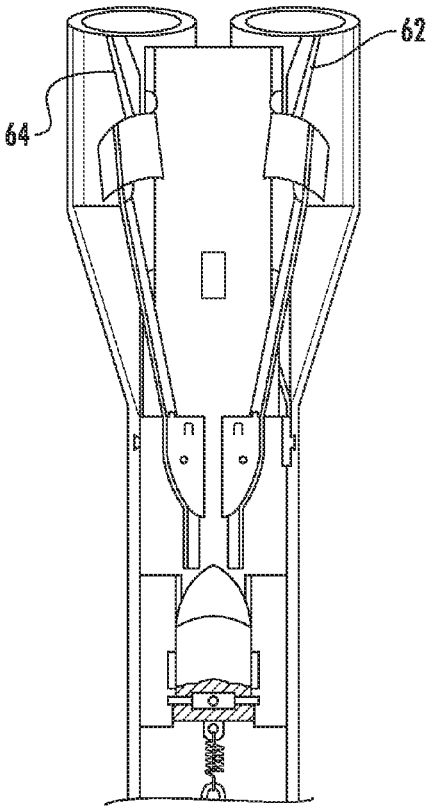

The receiver 14 may include one or more carrier latches for further preventing ammunition from being forced from the double chamber magazine 12 into the receiver 14. For example, FIG. 6 is a cross-sectional top view of a portion of the receiver 14 including a first carrier latch 62 and a second carrier latch 64. The carrier latches 62 and 64 may be positioned adjacent the open end 28 of the double-chamber magazine 12 when the magazine is secured to the receiver to prevent the ammunition 22 from being forced out of the magazine 12 into the receiver 14. The carrier latches 62 and 64 may retract when it is desired to feed a round from the magazine 12 into the receiver 14, such as when one or more rounds of ammunition are being discharged from the firearm 10.

A user may load one or more rounds of ammunition 22 into the double-chamber magazine 12 before securing the magazine to the receiver. For example, one or more rounds of slug-type ammunition may be inserted into the first magazine chamber 18 for breaching a doorway while one or more rounds of buckshot-type ammunition may be inserted into the second magazine chamber 20.

The magazine 12 is then secured to the receiver 14. For example, referring to FIG. 1, the magazine 12 may be pivotally secured to the receiver 14 using a lower magazine cradle 66 and an upper magazine cradle 68. The lower magazine cradle 66 may be fixed to the receiver 14 while the upper magazine cradle 68 is hingedly secured to the receiver with hinge 70. The magazine 12 is slidably secured to the upper magazine cradle 68. The upper magazine cradle 68 and magazine 12 may then be pivoted towards the receiver until the magazine 12 is releasably secured to the receiver 14 such that the magazine release lever 52 engages the magazine 12.

After the magazine 12 is secured to the receiver 14, the tabs 58 of the shell retainers 56 retract. After the shell retainers 56 retract, the carrier latches 62 and 64 prevent one or more rounds of ammunition 22 from either the first magazine chamber 18 or the second magazine chamber 20 from being forced from the double-chamber magazine into the receiver.

The user then selects which type of ammunition to be discharged by selecting either the first magazine chamber 18 or the second magazine chamber 20 with the selector switch 32. If the user selects the first magazine chamber 18 with the selector 30, the selector 30 is positioned such that it obstructs at least a portion of the open end 18 of the second magazine chamber 20, allowing the one or more rounds of slug-type ammunition 22 to be forced from the magazine 12 into the receiver 14.

If the user desires to breach a doorway, the user may discharge one round of slug-type ammunition from the first magazine chamber 18 and then press the selector switch 32 such that the selector 30 moves from the first position to the second position where the first magazine chamber 18 is partially obstructed by the selector 30 and the one or more rounds of buckshot-type ammunition in the second magazine chamber 20 are forced into the receiver 14.

If the user discharges all of the slug-type rounds of ammunition in the first magazine chamber 18, the selector 30 automatically switches to the ammunition in the second magazine chamber 20 when the plunger 24 contacts the striker 34 in accordance with the embodiment above. Alternatively, if the user manually switches to the second magazine chamber 20 and discharges all rounds within the second magazine chamber 20, the selector 30 automatically switches back to the first magazine chamber 18 until all rounds of ammunition with the first magazine chamber 18 have been discharged.

The selectable double-chamber magazine firearm therefore allows two different types of ammunition to be loaded into the firearm in a replaceable magazine. A user may select the type of ammunition to be discharged. Further, the selectable double-chamber magazine firearm automatically switches from one type of ammunition to another type of ammunition if all of the first type of ammunition is discharged from the firearm.

Figure 7:
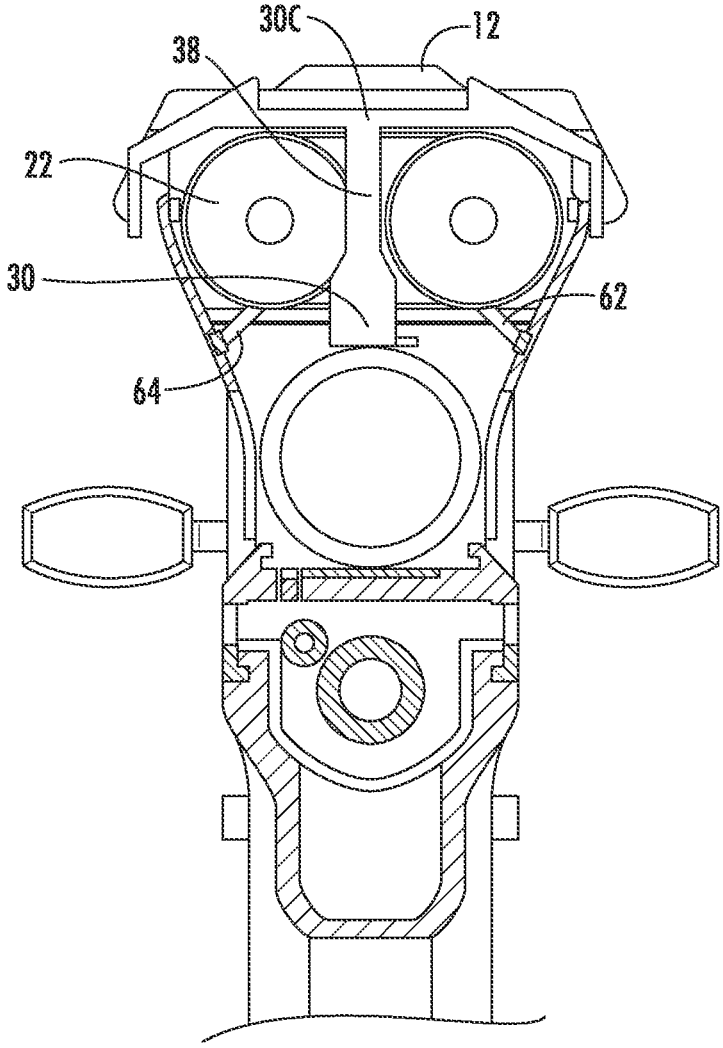
FIG. 7 is a cross-sectional view down a length of the selectable double-chamber firearm.

The double-chamber magazine firearm may also be incorporated into a firearm also including rifle components as shown in FIG. 1. The double-chamber magazine 12 may be secured above the receiver 14, which allows a rifle portion to be secured below the double-chamber magazine 12, as illustrated in FIG. 7.

Figure 8:
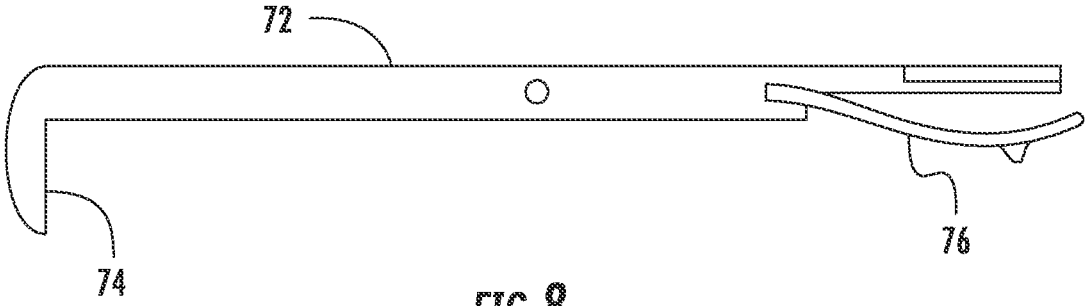
FIG. 8 is a side view of a bolt retainer according to one embodiment of the present disclosure.

In one embodiment, the selectable double-chamber firearm 10 includes a bolt retainer 72 pivotally secured to the receiver 14, the bolt retainer 72 including a bolt retainer catch 74 and a bolt retainer spring 76 as shown in FIG. 8. Referring now to FIG. 3A, when the selector 30 is in the middle position 30A, such as after all rounds of ammunition 22 have been discharged from the firearm 10, the bolt retainer spring 76 engages the selector 30 such that the bolt retainer 72 pivots, forcing the bolt retainer catch 74 in a downward direction. When the bolt retainer catch 74 moves downward it engages a bolt 78 of the firearm 10 such that the bolt 78 is retained in an open position. When a user re-loads the firearm 10 and depresses the selector switch 32, the retainer catch spring 76 disengages the selector 30 such that the bolt retainer catch 74 pivots upwards allowing the bolt 78 to close thereby chambering a round of ammunition in the firearm such that the firearm is ready to discharge the ammunition.

The rifle portion of the firearm 10 may be comprised of, for example, a bull-pup style rifle wherein a rifle magazine 100 and rifle action 102 are positioned behind a trigger 104 of the rifle portion. The bull-pup style rifle allows the firearm 10 to be more compact by reducing the overall length of the firearm 10.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A selectable double-chamber magazine firearm comprising:

a receiver;

at least one barrel adjacent the receiver;

a double-chamber magazine releasably secured to the receiver, the double-chamber magazine comprising a first elongate magazine chamber; and a second elongate magazine chamber adjacent to and parallel with the first elongate magazine chamber;

a selector secured adjacent an open end of the first elongate magazine chamber and an open end of the second elongate magazine chamber, the selector configured to move between a first position such that the selector at least partially obstructs the open end of the second elongate magazine chamber, a middle position such that the selector partially blocks the first and second magazine chambers, and a second position such that the selector at least partially obstructs the open end of the first elongate magazine chamber.

2. The selectable double-tube magazine firearm of claim 1 further comprising:

a first selector striker secured adjacent the open end of the first elongate magazine chamber;

a second selector striker secured adjacent the open end of the second elongate magazine chamber;

a selector bar secured to the selector between the first selector striker and the second selector striker;

a first plunger slidably engaged within the first elongate magazine chamber, the first plunger further comprising a first plunger spring between the first plunger and a closed end of the first elongate magazine chamber;

a second plunger slidably engaged within the second elongate magazine chamber, the second plunger further comprising a second plunger spring between the second plunger and a closed end of the second elongate magazine chamber;

wherein when the first plunger is adjacent the open end of the first elongate magazine chamber the first plunger contacts the first striker, the first striker moves from a first position to a second position contacting the selector bar and thereby urging the selector from the first selector position to the second selector position; and wherein when the second plunger is adjacent the open end of the second elongate magazine chamber the second plunger contacts the second striker, the second striker moves from a first position to a second position contacting the selector bar and thereby urging the selector from the second selector position to the first selector position.

3. The selectable double-chamber magazine firearm of claim 2, further comprising a magazine release lever.

4. The selectable double-chamber magazine firearm of claim 3, wherein the magazine release lever is in mechanical communication with the first selector striker and the second selector striker such that when the release lever is activated the first selector striker and second selector striker are turned to the first striker position.

5. The selectable double-chamber magazine firearm of claim 1 further comprising:

a first shell retainer pivotally secured to the first elongate magazine chamber, the first shell retainer extending at least partially over the open end of the first elongate magazine chamber when the double-chamber magazine is released from the receiver; and a second shell retainer pivotally secured to the second elongate magazine chamber, the second shell retainer extending at least partially over the open end of the second elongate magazine chamber when the double-chamber magazine is released from the receiver.

6. The selectable double-chamber magazine firearm of claim 1, wherein the receiver further comprises an elongate second barrel secured adjacent the receiver.

7. The selectable double-chamber magazine firearm of claim 6, wherein the double-chamber magazine is positioned above the second barrel.

8. The selectable double-chamber magazine of claim 6, wherein the receiver further comprises a rifle portion.

9. A selectable double-chamber magazine firearm comprising:

a receiver;

a barrel secured adjacent to the receiver;

a double-chamber magazine releasably secured to the receiver, the double-chamber magazine comprising:

a first elongate magazine chamber, a second elongate magazine chamber adjacent to and parallel with the first elongate magazine chamber, a first shell retainer pivotally secured to the elongate magazine chamber, the first shell retainer extending at least partially over the open end of the first elongate magazine chamber when the double-chamber magazine is released from the receiver; and a second shell retainer pivotally secured to the second elongate magazine chamber, the second shell retainer extending at least partially over the open end of the second elongate magazine chamber when the double-chamber magazine is released from the receiver;

a selector secured adjacent an open end of the double-chamber magazine;

wherein when the selector is in a first configuration, the selector at least partially obstructs the open end of the second elongate magazine chamber;

wherein when the selector is in a second configuration, the selector at least partially obstructs the open end of the first elongate magazine chamber; and, wherein when the selector is in a third configuration, the selector partially blocks the first and second magazine chambers.

10. The selectable double-chamber magazine firearm of claim 1, wherein when all ammunition from the first elongate magazine chambers is discharged, the selector is operable to automatically move from the first position to the second position.

11. The selectable double-chamber magazine firearm of claim 1, wherein when all ammunition from the second elongate magazine chambers is discharged, the selector is operable to automatically move from the second position to the middle position.

12. A selectable double-chamber magazine firearm comprising:

at least one barrel adjacent the receiver;

a double-chamber magazine releasably secured to the receiver, the double-chamber magazine comprising a first elongate magazine chamber; and a second elongate magazine chamber adjacent to and parallel with the first elongate magazine chamber;

a selector secured adjacent an open end of the first elongate magazine chamber and an open end of the second elongate magazine chamber, the selector configured to move between a first position such that the selector at least partially obstructs the open end of the second elongate magazine chamber and a second position such that the selector at least partially obstructs the open end of the first elongate magazine chamber;

a first selector striker secured adjacent the open end of the first elongate magazine chamber;

a second selector striker secured adjacent the open end of the second elongate magazine chamber;

a selector bar secured to the selector between the first selector striker and the second selector striker;

a first plunger slidably engaged within the first elongate magazine chamber, the first plunger further comprising a first plunger spring between the first plunger and a closed end of the first elongate magazine chamber;

a second plunger slidably engaged within the second elongate magazine chamber, the second plunger further comprising a second plunger spring between the second plunger and a closed end of the second elongate magazine chamber;

wherein when the first plunger is adjacent the open end of the first elongate magazine chamber the first plunger contacts the first striker, the first striker moves from a first position to a second position contacting the selector bar and thereby urging the selector from the first selector position to the second selector position; and wherein when the second plunger is adjacent the open end of the second elongate magazine chamber the second plunger contacts the second striker, the second striker moves from a first position to a second position contacting the selector bar and thereby urging the selector from the second selector position to the first selector position.

13. The selectable double-chamber magazine firearm of claim 12, further comprising a magazine release lever.

14. The selectable double-chamber magazine firearm of claim 13, wherein the magazine release lever is in mechanical communication with the first selector striker and the second selector striker such that when the release lever is activated the first selector striker and second selector striker are turned to the first striker position.

15. The selectable double-chamber magazine firearm of claim 12, wherein the selector engages a bolt in the receiver of the selectable-double chamber magazine firearm when the selector is in the middle position, thereby maintaining the bolt in an open position.

* * * * *